US005813339A

United States Patent [19]

Schmitt et al.

[11] Patent Number: 5,813,339

[45] Date of Patent: Sep. 29, 1998

[54] CARTRIDGE FOR REFILLING A PRINTING CARTRIDGE WITH INK

[75] Inventors: Franz-Ulrich Schmitt; Kurt Moser, both of Gerlingen; Friedhelm Czeranski, Dortmund; Christian Geiermann, Wuppertal, all of Germany

[73] Assignee: Laser Care Modul Recycling GmbH, Ohringen, Germany

[21] Appl. No.: 941,225

[22] Filed: Sep. 30, 1997

[30] Foreign Application Priority Data

Nov. 7, 1996 [DE] Germany ..... 296 19 296.1

[51] Int. Cl.[6] ..... B41F 35/00

[52] U.S. Cl. ..... 101/335; 101/366; 347/86

[58] Field of Search ..... 101/335, 202, 101/103, 366; 400/191; 347/86, 85, 84, 87; 346/140.1; 141/329, 330, 372, 375

[56] References Cited

U.S. PATENT DOCUMENTS

| | | | |
|---|---|---|---|
| 2,574,028 | 11/1951 | Fields et al. | 141/329 |
| 4,162,501 | 7/1979 | Michell et al. | 346/140 |
| 4,183,031 | 1/1980 | Kyser et al. | 347/86 |
| 4,700,202 | 10/1987 | Kuranishi et al. | 347/86 |
| 4,867,209 | 9/1989 | Santoiemmo | 141/329 |

FOREIGN PATENT DOCUMENTS

| | | |
|---|---|---|
| 2725271C2 | 12/1977 | Germany . |
| 4327178C1 | 3/1995 | Germany . |
| 4438590A1 | 6/1995 | Germany . |

*Primary Examiner*—Edgar S. Burr
*Assistant Examiner*—Anthony H. Nguyen
*Attorney, Agent, or Firm*—Evenson, McKeown, Edwards & Lenahan P.L.L.C.

[57] ABSTRACT

A refilling cartridge is provided for refilling a jet printer cartridge with ink. The refilling cartridge includes a housing for a foil pouch refilling chamber and a hollow needle projecting from the housing. A rubber elastic sealing element is provided at a free end of the needle to be selectively penetrated by the needed. The sealing element is secured by a movable retaining element that shields the hollow needed and is movable in a lengthwise direction of the hollow needle to selectively expose the free end of the hollow needle. A spring element holds the retaining element in a position where the sealing element seals the open end of the needle and releasable locking elements are provided for the retaining element.

20 Claims, 2 Drawing Sheets

CARTRIDGE FOR REFILLING A PRINTING CARTRIDGE WITH INK

BACKGROUND AND SUMMARY OF THE INVENTION

This application claims the priority of German application 296 19 296.1 filed in Germany on Nov. 7, 1996, the disclosure of which is expressly incorporated by reference herein.

The invention relates to a cartridge for refilling a printing cartridge of an ink jet printer or the like with ink, with a chamber that holds a supply of ink.

It is known from German Patent Document (DE 43 27 178 C1) to design the chamber as a cartridge that consists essentially of a cylindrical sleeve closed at one end by a removable cap and at the other end by a plug. To fill a printing cartridge, this printing cartridge is placed in a device. This device is provided with an upper part that has a cannula that is inserted into the printing cartridge and which is also thrust through the plug into the cartridge when the cartridge containing the ink supply is mounted. In order to allow the ink contained in the cartridge to run out into the printing cartridge, the cap opposite the plug is removed so that the cartridge is open. In the known design, the use of a cannula that is supposed to penetrate the plug when the cartridge is mounted on it is especially disadvantageous. Firstly, there is the danger that the cannula will not properly penetrate the plug and will push said plug into the cartridge. The situation can then arise that there is no connection to the chamber or that the plug is pushed all the way into the cartridge so that the ink supply runs out uncontrolled and leads to contamination.

A goal of the invention is to design a cartridge of the species recited at the outset in such fashion that it is easy to handle without there being any significant danger of the ink escaping.

This goal is achieved according to the invention by virtue of the fact that the refilling cartridge chamber is designed as a foil pouch surrounded by a solid housing and provided with a hollow needle that projects from the housing, with the free end of said needle being provided with a rubber-elastic sealing element to be penetrated by the hollow needle, said element being secured by a retaining element that shields the hollow needle and can be moved in the lengthwise direction of the hollow needle to expose the free end of the hollow needle.

Since the hollow needle communicates with the interior of the foil pouch, assurance is provided that only the hollow needle will be exposed as the maximum outlet opening for the ink. The rubber-elastic sealing element has the advantage that it is merely penetrated by the hollow needle without a hole being punched in the sealing element in the process. When the retaining element together with the sealing element is returned to the closed position, the perforation in the sealing element closes for the most part so that the cartridge can be removed without drops of ink escaping. In addition, the use of the foil pouch has the advantage that the pouch empties without a vent opening or stress by the compressive forces exerted by the operator so that the ink does not escape from the foil pouch under pressure.

The design of certain preferred embodiments of the invention provides that the retaining element is held in position by a spring element, in which the sealing element seals the free end of the hollow needle. This ensures that the hollow needle does not penetrate the sealing element inadvertently but only when a certain force is applied by which the force of the spring element is overcome.

In certain preferred embodiments of the invention, provision is made such that the retaining element is lockable in position by releasable locking elements, in which position the free end of the hollow needle is exposed. This ensures that the operator does not have to press the cartridge against spring force when refilling a printing cartridge. The locking elements ensure that the open position is maintained so that the operator can release the cartridge. Since the locking elements on the other hand are releasable, after the locking elements are removed the spring element causes the retaining element to assume the closed position together with the sealing element so that the escape of ink is prevented to the greatest degree possible when it has been removed.

DETAILED DESCRIPTION OF THE DRAWINGS

Figure 1:
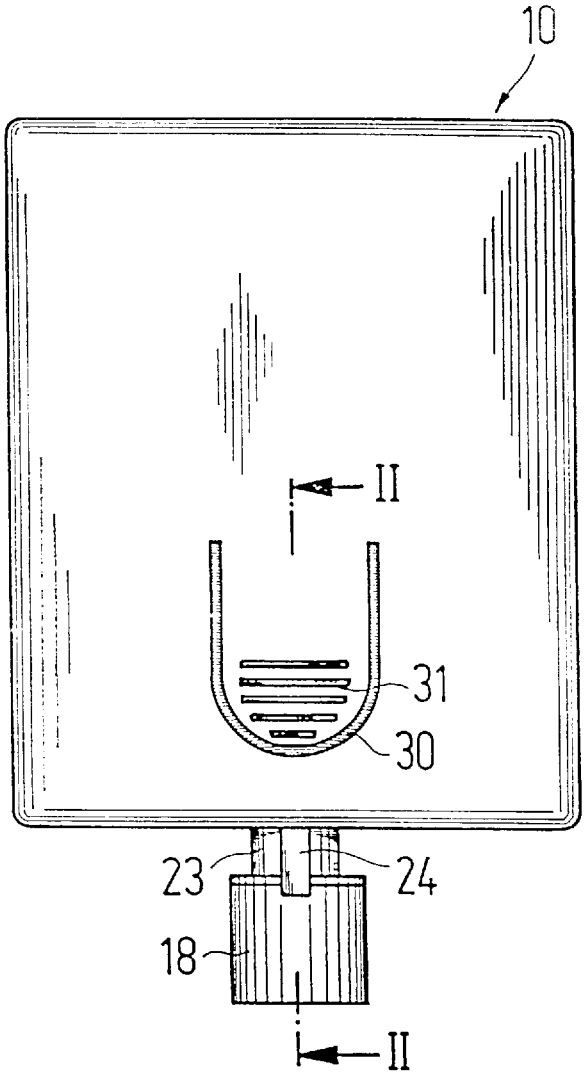
FIG. 1 is a side view of a cartridge according to the invention.

Cartridge 10 has a parallelepipedic housing made of plastic that is assembled from two shells 11, 12, said shells being joined to one another in the vicinity of their narrow sides. A foil pouch 13 is accommodated inside housing 11, 12, said pouch forming a chamber to hold an ink supply. An insert 14 is welded in one edge of foil pouch 13, with a hollow needle 15 being fastened in said insert. Hollow needle 15 has an outside diameter of approximately 1 mm. Hollow needle 15 has its free end projecting from foil pouch 13 and from housing 11, 12 in the vicinity of one narrow side of housing 11, 12.

Insert 14 is provided with a flange 16 that is held positively by virtue of its shape between one end wall of housing 10, 11 and inserts molded thereon and surrounding flange 16.

The part of hollow needle 15 that protects from housing 11, 12 is surrounded by a pot-shaped retaining element 18 that holds a disc-shaped or late-shaped sealing element 19 made of rubber-elastic material in the vicinity of its bottom. Sealing element 19 in the initial state (left side of FIG. 2 seals the open end of hollow needle 15 which is preferably easily pushed into sealing element 19. On the side opposite the bottom of the pot-shaped retaining element, sealing element 19 is supported by means of a plate 20 provided with a guide sleeve 21 surrounding hollow needle 15. Guide sleeve 21 surrounds hollow needle 15 with relatively little play so that it forms an additional seal. A compression spring 22 is located between insert 14 and plate 20. Pot-shaped retaining element 18 is guided on partially cylindrical guide projections 23 of housing 10, 11 which project outward from the end of housing 11, 12.

Figure 2:
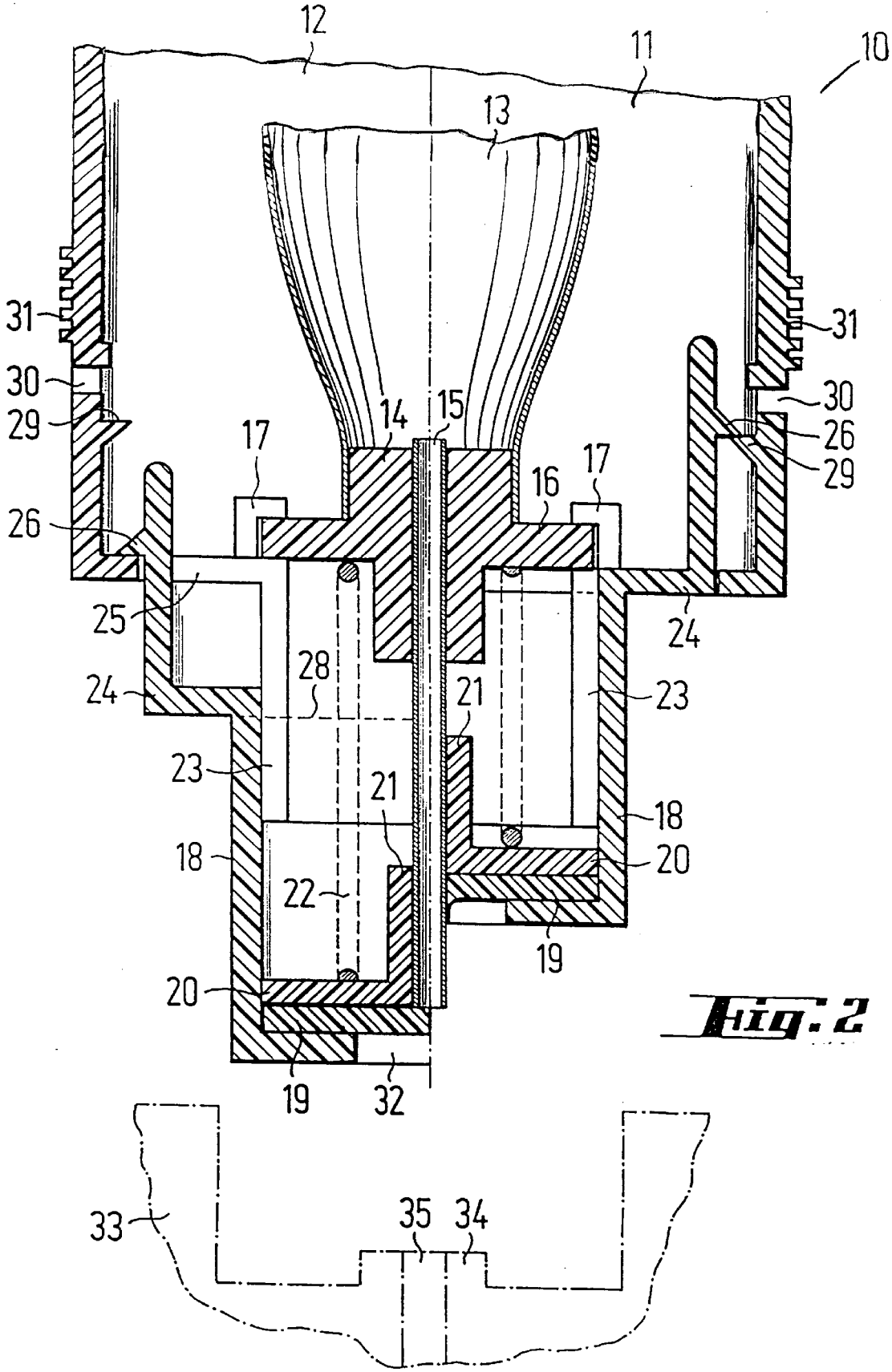
FIG. 2 is a partial section along line II-II of the cartridge in FIG. 1 on an enlarged scale, with the left half of FIG. 2 showing the cartridge in the original state and the right half showing the cartridge in the state in which the free end of a hollow needle is exposed.

Two fingers 24 abut the open side of pot-shaped retaining element 18, said fingers each projecting through a slot 25 in housing 11, 12 into its interior. Fingers 24 are provided with locking noses 26 that internally abut the end wall of housing 11, 12 in the initial position (FIG. 2, left).

Pot-shaped retaining element 18 can be displaced in the lengthwise direction of hollow needle 15 on guide projections 23 into the interior of housing 10, 11, with the force of compression spring 22 having to be overcome and sealing element 19 having to be pierced. The displacement movement of retaining element 18 in the direction of the interior of the housing is limited by the fact that the edge 28 of the pot-shaped retaining element abuts the exterior of the end wall of housing 11, 12.

The side walls of housing 11, 12 are provided with molded stops 29 that fit behind the latching noses 26 of fingers 24 so that the retaining element is locked into the position in which the free end of hollow needle 15 is exposed.

Unlocking tabs 31 are incorporated into the side walls of housing 11, 12 by means of a U-shaped slot 30. The unlocking tabs, which are located opposite fingers 24 in the released position (FIG. 2, right) can be pressed manually inward into the housing. As this takes place, the tabs bring fingers 24 inward with them so that the locking or latching noses 26 come free from stops 29. Compression spring 22 then pushes retaining element 18 away from the housing until latching noses 26 again abut the interior of the end wall of housing 11, 12 (FIG. 2, left). Sealing element 19 that is pierced by hollow needle 15 is made of a rubber-elastic material so that the pierced opening closes again when sealing element 19 is moved away over the free end of hollow needle 15.

To refill a printing cartridge, cartridge 10 together with the essentially cylindrical retaining element 18 is set from above into a device 33 indicated by the dot-dashed lines at the bottom of FIG. 2. Device 33 has a guide recess adapted to retaining element 18. In the middle of the guide recess is a projection 34 that extends upward, said projection having an outside diameter slightly smaller than the diameter of a central bore 32 in the bottom of retaining element 18. Projection 34 forms a counterbearing for sealing element 19. Cartridge 10 is then pushed further downwards so that hollow needle 15 penetrates the sealing element and enters a bore 35 whose inside diameter is slightly larger than the outside diameter of hollow needle 15. This bore 35 can be another hollow needle for example that leads into the interior of a printing cartridge, not shown. Cartridge 10 is pressed downward until edge 28 of retaining element 18 strikes the end of housing 11, 12 and locking noses 26 engage stops 29. The operator can then release cartridge 10 and wait until the contents of foil pouch 13 have emptied. Foil pouch 13 releases the ink it contains without force being exerted on it from the exterior and without opening of a vent opening or the like in foil pouch 13 being necessary. After the printing cartridge has been filled, unlocking tabs 31 are pressed so that locking noses 26 of fingers 24 are moved away from stops 29. Compression spring 22 then presses housing 11, 12 upward until locking noses 26 abut the interior of the end wall of housing 11, 12. Sealing element 29 then closes almost completely over the free end of hollow needle 15 so that cartridge 10 can be removed without the risk of ink dripping out.

Usually the contents of foil pouch 13 are dimensioned so that the amount is slightly less than the maximum quantity of ink that a printing cartridge can hold. Foil pouch 13 can then be emptied practically completely. Even if foil pouch 13 is not intended to be completely emptied when cartridge 10 is removed, for example because refilling was performed although the printing cartridge was not completely empty, there is no risk of the ink escaping since sealing element 19 recloses the open end of hollow needle 15 when cartridge 10 is removed.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A cartridge for refilling a printing cartridge with ink, comprising:

a chamber which holds an ink supply, said chamber comprising a foil pouch and a solid housing, said solid housing surrounding said foil pouch;

a hollow needle projecting from said solid housing and having a free end;

a rubber elastic sealing element arranged at said free end of said hollow needle and being penetrated by said hollow needle;

a retaining element arranged to secure said rubber elastic sealing element and to shield said hollow needle;

wherein said retaining element is moveable in a lengthwise direction of said hollow needle to expose said free end.

2. The cartridge according to claim 1, further comprising a spring element which holds the retaining element in a position in which the sealing element seals an open end of the hollow needle.

3. The cartridge according to claim 1, further comprising releasable locking elements which lock the retaining element in a position in which an open end of the hollow needle is exposed.

4. The cartridge according to claim 2, further comprising releasable locking elements which lock the retaining element in a position in which the open end of the hollow needle is exposed.

5. The cartridge according to claim 1, wherein the foil pouch is provided with an insert that holds the hollow needle and is secured to an end of the solid housing, a part of the retaining element that surrounds a section of said hollow needle projecting from the foil pouch is mounted on said insert.

6. The cartridge according to claim 1, wherein the retaining element has a pot shape and is also guided by ends of projections extending from an end of the solid housing.

7. The cartridge according to claim 1, wherein the retaining element includes fingers that extend into the solid housing, said fingers having latching noses that internally abut an end of the solid housing when the hollow needle is in a closed position.

8. The cartridge according to claim 4, wherein the foil pouch is provided with an insert that holds the hollow needle and is secured to an end of the solid housing, a part of the retaining element that surrounds a section of said hollow needle projecting from the foil pouch is mounted on said insert.

9. The cartridge according to claim 8, wherein the retaining element has a pot shape and is also guided by ends of projections extending from an end of the solid housing.

10. The cartridge according to claim 9, wherein the retaining element includes fingers that extend into the solid housing, said fingers having latching noses that internally abut an end of the solid housing when the hollow needle is in a closed position.

11. The cartridge according to claim 7, wherein the solid housing has sidewalls, and further comprising stops provided in a vicinity of said side walls, said stops being associated with said latching noses of said fingers of the retaining element, said latching noses fitting behind said stops in a position of the retaining element in which an open end of the hollow needle is exposed.

12. The cartridge according to claim 8, wherein the solid housing has sidewalls, the cartridge further comprising stops provided in a vicinity of said sidewalls, unlocking tabs movable inward into the solid housing, and fingers of the retaining element having latching noses, wherein said unlocking tabs release said latching noses of the fingers from the stops.

13. The cartridge according to claim 10, wherein the solid housing has sidewalls, and further comprising stops provided in a vicinity of said side walls, said stops being associated with said latching noses of said fingers of the retaining element, said latching noses fitting behind said stops in a position of the retaining element in which the open end of the hollow needle is exposed.

14. The cartridge according to claim 13, wherein the side walls of the housing are provided in a vicinity of the stops with unlocking tabs, the unlocking tabs being movable inward into the housing and releasing said latching noses of the fingers from the stops.

15. The cartridge according to claim 1, further comprising a compression spring which urges the retaining element in the direction of the solid housing.

16. The cartridge according to claim 15, further comprising a plate located inside the retaining element, a guide on the hollow needle which guides said plate, and a disc-shaped sealing element located between the plate and a bottom of the retaining element, said bottom having an opening.

17. The cartridge according to claim 15, wherein the compression spring is located between a plate and an insert of the foil pouch.

18. The cartridge according to claim 14, further comprising a compression spring which urges the retaining element in the direction of the solid housing.

19. The cartridge according to claim 17, wherein the plate is located inside the retaining element, and further comprising a guide, on the hollow needle which guides said plate, and a disc-shaped sealing element located between the plate and a bottom of the retaining element, said bottom having an opening.

20. The cartridge according to claim 18, wherein the compression spring is located between a plate and the insert of the foil pouch.

* * * * *